United States Patent [19]

Orpwood et al.

[11] Patent Number: 4,995,628

[45] Date of Patent: Feb. 26, 1991

[54] STANDING FRAME ASSEMBLY FOR USE WITH WHEELCHAIR

[75] Inventors: Roger Orpwood, Bath; Ian D. Swain, Wiltshire, both of England

[73] Assignee: Hodgkinson & Corby Limited, London, England

[21] Appl. No.: 369,498

[22] Filed: Jun. 23, 1989

[30] Foreign Application Priority Data

Jun. 23, 1988 [GB] United Kingdom ..... 8814979

[51] Int. Cl.[5] ..... A61G 5/14

[52] U.S. Cl. ..... 280/304.1; 280/763.1; 297/310; 297/DIG. 4; 410/51

[58] Field of Search ..... 280/304.1, 763.1, 767; 297/310, DIG. 4; 296/65 R; 410/3, 7, 51

[56] References Cited

U.S. PATENT DOCUMENTS 3,759,544 9/1973 Korpela ..... 280/304.1

FOREIGN PATENT DOCUMENTS 293397 2/1968 Australia ..... 280/763.1
2173454 10/1986 United Kingdom ..... 280/763.1
2178375 2/1987 United Kingdom ..... 297/DIG. 4

*Primary Examiner*—Mitchell J. Hill
*Attorney, Agent, or Firm*—Fleit, Jacobson, Cohn, Price, Holman & Stern

[57] ABSTRACT

A wheelchair which utilizes a standing frame assembly which includes an arm rest frame which may be formed integrally or detachably mountable on the wheelchair, and a holding lever is pivotally mounted on the frame between a lower position and a raised position in which it is arranged in front of and above the seat of the wheelchair. A ground engaging member is movable under the action of the movement of the lever, so that it can be moved between a retracted position with the lever in its lower position and a ground engaging position in front of the wheelchair when the lever is in its raised position. A locking device is provided to lock the ground engaging member and the lever when the latter is in its raised position.

9 Claims, 2 Drawing Sheets

STANDING FRAME ASSEMBLY FOR USE WITH WHEELCHAIR

BACKGROUND OF THE INVENTION

1. Field of the Invention

The present invention relates to wheelchairs and a standing frame assembly for use in conjunction therewith.

2. Description of the Related Art

Typically people who use wheelchairs are handicapped in one way or another and often have difficulty in sitting down in the wheelchair or standing up from the wheelchair. Very often they require assistance by a third party holding a standing frame or zimmer firmly while they stand up or sit down and obviously this makes the patient dependent on others.

SUMMARY OF THE INVENTION

According to the present invention it is proposed to provide a standing frame assembly for use in conjunction with a wheelchair, said assembly comprising an arm rest frame detachably mountable on the wheelchair, a holding lever pivotally mounted on the frame between a lowered position and a raised position in which it is arranged in front of and above the seat of the wheelchair and a ground engaging member movable, under the action of movement of said lever, so that it is retracted with the lever in its lower position and it is in a ground engaging position in front of the wheelchair when the lever is in its raised position, means being provided to lock the ground engaging member and the lever when the latter is in its raised position.

A pair of such standing frame assemblies can be provided in place of the standard arm rest assemblies on a wheelchair and enable the chair to be used in a perfectly normal way for wheeling a patient around either by himself or with assistance, and yet enable the patient very readily to stand up from the chair and sit down into the chair. All that is necessary is for the holding lever to be grasped and moved from the lower position to the raised position and for the assembly then to be locked. The ground-engaging member is firmly positioned against the ground and the patient can apply a substantial force on the holding lever which will remain rigid while he gets into or out of the chair.

While it is conventional for wheelchairs to have removable arms to facilitate a patient being moved sideways onto a bed or other chair, it is also contemplated, according to the invention, to have the arm rest frame formed as an integral part of the chair so that, according to another aspect of the invention, it is proposed to have a wheelchair provided with an arm rest on each side, each arm rest comprising an arm rest frame mounted on the wheelchair, a holding lever pivotally mounted on the frame between a lowered position and a raised position in which it is arranged in front of and above the seat of the wheelchair and a ground engaging member movable, under the action of movement of said lever, so that it is retracted with the lever in its lower position and it is in a ground engaging position in front of the wheelchair when the lever is in its raised position, means being provided to lock the ground engaging member and the lever when the latter is in its raised position.

Various ways of interconnecting the holding lever and the ground engaging member are contemplated. These can be pivotally interconnected entirely and accordingly then could include a fixed part either integrally or detachably mounted on the wheelchair, and a pivotal portion which is pivotally connected both to said fixed portion and to said lever. As indicated, while the ground engaging portion could itself form part of a pivotal linkage, it is also proposed it should be mounted for sliding motion from its ground engaging position to its retracted position in a rearward and upward direction, the ground engaging member being pivotally connected to a lower part of the lever.

Various forms of locking means are contemplated, and one of these involves the use of a cam engageable between the fixed part of the frame and the sliding part of the ground engaging member, the cam being operable by a locking handle. An alternative is for the locking means to comprise a spring loaded detent which is releable by an actuator at the free end of the lever.

BRIEF DESCRIPTION OF THE DRAWING

In order that the invention may more readily be understood, the following description is given, merely by way of example, reference being made to the accompanying drawings, in which.

DESCRIPTION OF THE DISCLOSED EMBODIMENT

Figure 1:
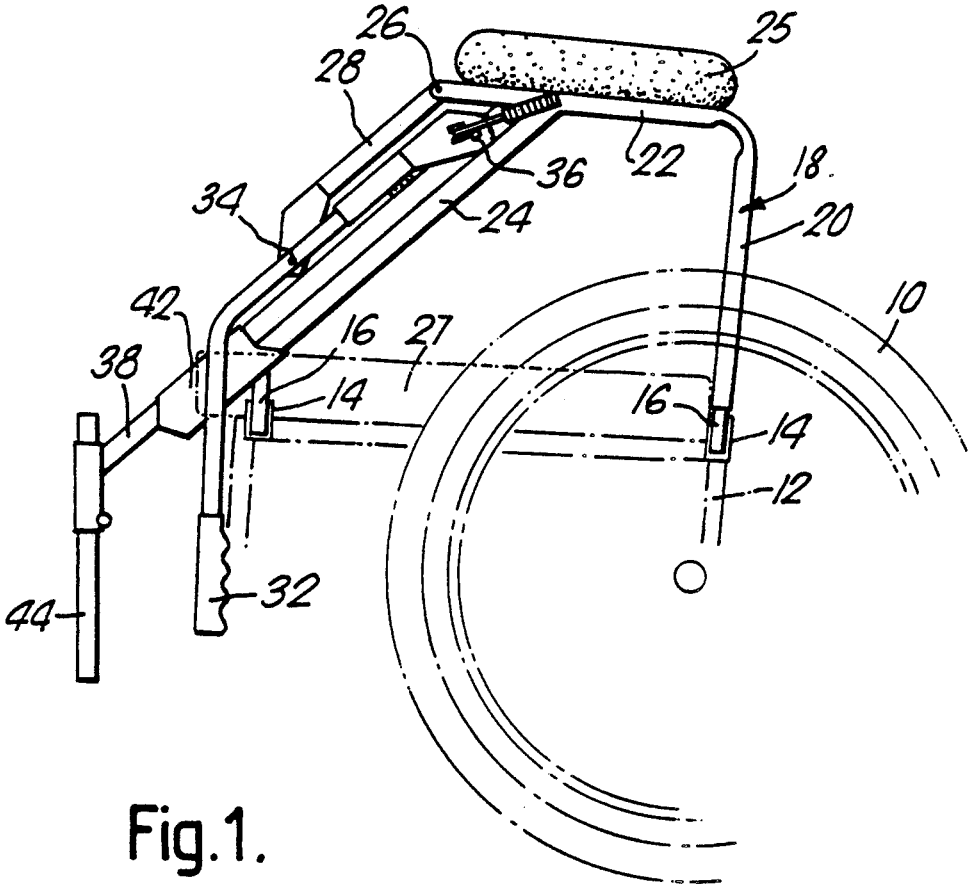
FIG. 1 is a schematic side elevation of a portion of a wheelchair provided with one embodiment of standing frame assembly according to the present invention, with the holding lever in its lowered position and the ground-engaging member retracted.

Referring first to FIG. 1, there is schematically illustrated therein one of the two larger wheels of a wheelchair, and a portion 12 of the wheelchair body. Inserted into sockets 14 carried by this body portion 12 are spigots 16 formed on the lower ends of an arm rest frame 18. This frame includes a downwardly extending rear tube 20, a horizontal tube 22 and a downwardly and forwardly angled tube 24, these forming collectively a fixed part of the arm rest frame. An arm rest 25 is carried by the horizontal tube 22. The seat of the wheelchair is illustrated schematically at 27.

Figure 2:
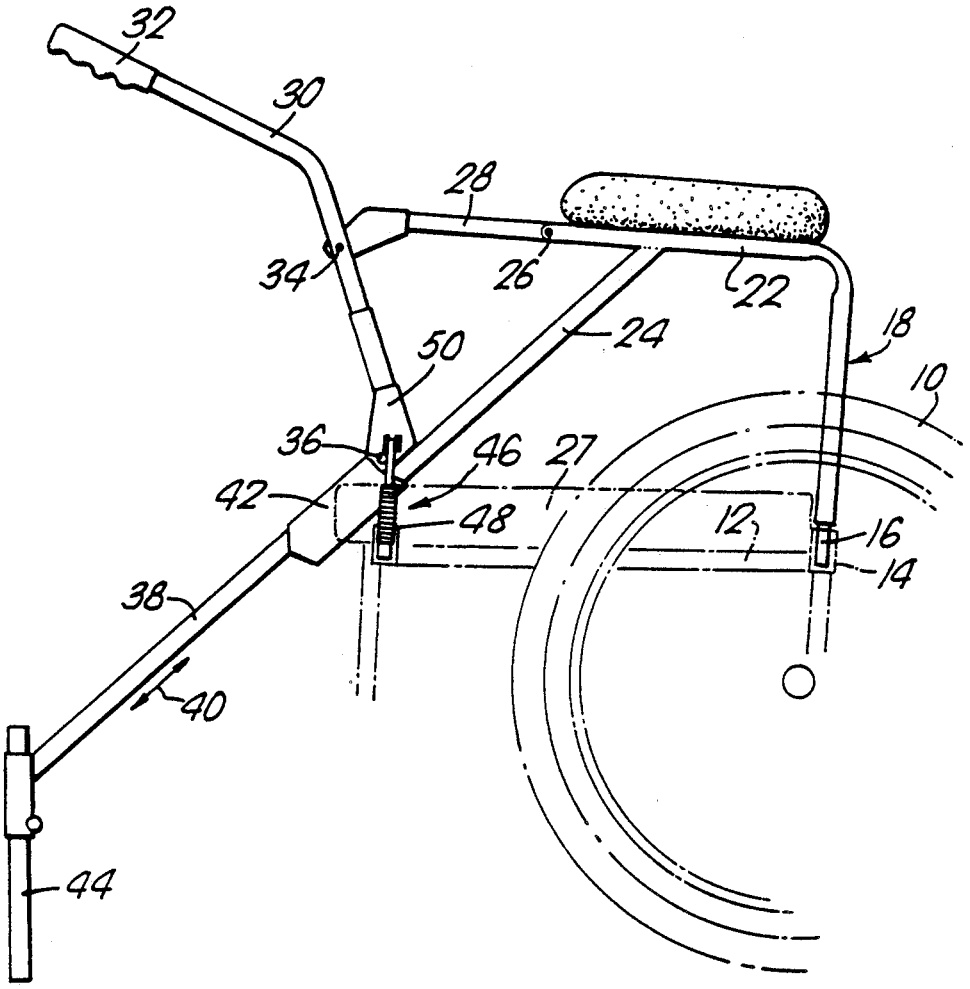
FIG. 2 is a similar view with the holding lever in its raised position and the ground-engaging member lowered.

These parts are also illustrated in FIG. 2. At the forward end of the horizontal tube 22 is provided a pivot 26 on which is pivotally mounted an upper pivotal portion 28.

A holding lever 30, having a handgrip 32 at its upper free end, is pivotally mounted at 34 to the free end of the pivotal portion 28, and at 36 to an axially slidable ground-engaging member 38. The sliding movement of this member 38 is indicated by the doubleheaded arrow 40 and is constrained by a guide sleeve 42 carried at the lower end of the angled tube 24. The member 38 is accurately guided by this guide sleeve 42 for controlled movement in the direction of the arrows 40 parallel and closely adjacent to the inclined tube 24.

At its lower end the member 38 is provided with a vertically adjustable foot 44 which can engage the ground in the position illustrated in FIG. 2 at a location in front of the wheelchair.

A clamp 46 comprises a clamp handle 48 and a cam (not shown), the handle 48 being rotatable on the lower part 50 of the holding lever 30 so that the rotation to the position shown in FIG. 2 will urge the cam against the tube 24, thereby preventing the member 38 from moving from the position illustrated, and at the same time preventing the holding lever 30 from pivoting about the point 34.

It will be appreciated that a wheelchair will be provided with two arm rest frames 18 and the associated parts 26 to 50 forming an assembly according to the invention, one assembly being positioned on each side of the wheelchair.

When it is decided to move the wheelchair forwardly or rearwardly, the clamp 46 of each assembly is released and the lever 30 pushed forwardly and downwardly so that both it and the pivotal portion 28 pivot downwardly to the position illustrated in FIG. 1. This movement causes the member 28 to move upwardly and to the right, to the position illustrated in FIG. 1 in which the foot 44 is well clear of the ground, thus enabling the wheelchair to be moved.

When the patient wishes to sit down in the wheelchair or stand up from the wheelchair, then each assembly is moved to the position illustrated in FIG. 2 and locked using clamp 46. The handle 32 can then readily be grasped by the patient who can sit down or stand up with full security, which is even greater than if a conventional standing frame or zimmer had been placed directly in front.

The construction of the present invention is relatively inexpensive and two of the assemblies can be easily placed on an existing wheel chair in place of the conventional armrest assemblies. As with such conventional assemblies, the construction of the invention can be removed to enable the patient to slide out to one side or the other of the wheelchair.

We claim:

1. A standing frame assembly for use in conjunction with a wheelchair, said assembly comprising:

an arm-rest frame detachably and fixedly mountable on the wheelchair such that when mounted, said arm-rest frame is restrained from movement relative to the wheelchair;

a holding member mounted to be rotatably movable relative to said arm-rest frame and movable from a lowered retracted position in front of the wheelchair to a raised position in which it is arranged in front of and above the seat of said wheelchair, and in which it may be used to assist the user in standing up from the wheelchair;

a ground engaging member;

a pivotal connection between said ground engaging member and said holding member;

means for mounting said ground engaging member whereby it is slidably movable relative to said arm-rest frame and movable to a retracted position with the holding member to its lower position and it is in a ground engaging position in front of the wheelchair when the holding member is in the raised position;

a locking means provided to prevent any relative rotation of said holding and ground engaging members when the ground engaging member is in the ground engaging position.

2. An assembly as claimed in claim 1, wherein the arm-rest frame comprises a fixed part, two wheelchair engaging portions on said fixed part for detachably mounting on the wheelchair, and a pivotal portion pivotally connected to both said fixed part and said holding member.

3. An assembly as claimed in claim 2, and further comprising mounting means to mount said ground engaging member for sliding motion from its ground engaging position to its retracted position in a rearward and upward direction and said mounting means pivotally connecting said ground engaging member to a lower part of the holding member.

4. An assembly as claimed in claim 1, wherein said locking means comprises a spring loaded detent which is releasable by an actuator at the free end of the member.

5. An assembly according to claim 1, wherein said ground engaging member comprises an upper part and a lower part adjustably mounted to said upper part, whereby said lower part is moveable vertically relative to said upper part and whereby it is said lower part of said ground engaging member which is engaged with the ground.

6. A wheelchair provided with an arm rest on each side, each arm rest comprising:

an arm-rest frame mounted to the wheelchair to restrain movement of said arm-rest frame relative to the wheelchair;

a holding member mounted to be rotatably movable relative to said arm-rest frame and movable from a lowered retracted position in front of the wheelchair to a raised position in which it is arranged in front of and above the seat of said wheelchair, and in which it may be used to assist the user in standing up from the wheelchair;

a ground engaging member;

a pivotal connection between said ground engaging member and said holding member;

means for mounting said ground engaging member whereby it is slidably movable relative to said arm-rest frame and movable to a retracted position with the holding member to its lower position and it is in a ground engaging position in front of the wheelchair when the holding member is in the raised position;

a locking means provided to prevent any relative rotation of said holding and ground engaging members when the ground engaging member is in the ground engaging position.

7. A wheelchair according to claim 6, wherein said ground engaging member comprises an upper part and a lower part adjustably mounted to said upper part, whereby said lower part is moveable vertically relative to said upper part and whereby it is said lower part of said ground engaging member which is engaged with the ground.

8. A wheelchair as claimed in claim 6, wherein the arm-rest frame comprises a fixed part, two wheelchair engaging portions on said fixed part for detachably mounting on the wheelchair, and a pivotal portion pivotally connected both to said fixed portion and to said lever.

9. A wheelchair as claimed in claim 8, and further comprising mounting means to mount said ground engaging member for sliding motion from its ground engaging position to its retracted position in a rearward and upward direction and said mounting means pivotally connecting said ground engaging member to a lower part of the holding member.

* * * * *